US010738778B2

(12) United States Patent
Hirano et al.

(10) Patent No.: US 10,738,778 B2
(45) Date of Patent: Aug. 11, 2020

(54) MOTOR-DRIVEN ROOTS PUMP

(71) Applicant: KABUSHIKI KAISHA TOYOTA JIDOSHOKKI, Aichi-ken (JP)

(72) Inventors: Takayuki Hirano, Kariya (JP); Daisuke Masaki, Kariya (JP); Shintaro Kashiwa, Kariya (JP); Naoki Takani, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 42 days.

(21) Appl. No.: 16/250,550

(22) Filed: Jan. 17, 2019

(65) Prior Publication Data

US 2019/0226480 A1 Jul. 25, 2019

(30) Foreign Application Priority Data

Jan. 22, 2018 (JP) ..... 2018-008316
Mar. 30, 2018 (JP) ..... 2018-070061

(51) Int. Cl.

| | |
|---|---|
| ***F04C 18/12*** | (2006.01) |
| ***F04C 15/00*** | (2006.01) |
| ***F04C 2/12*** | (2006.01) |
| ***F04C 18/16*** | (2006.01) |
| ***F04C 18/08*** | (2006.01) |
| ***F04C 29/02*** | (2006.01) |
| ***F04C 29/00*** | (2006.01) |

(Continued)

(52) U.S. Cl.

CPC ..... *F04C 18/126* (2013.01); *F04C 2/126* (2013.01); *F04C 15/0038* (2013.01); *F04C 15/0061* (2013.01); *F04C 15/0088* (2013.01); *F04C 18/08* (2013.01); *F04C 18/082* (2013.01); *F04C 18/084* (2013.01); *F04C 18/16* (2013.01);

(Continued)

(58) Field of Classification Search

CPC .... F04C 2/126; F04C 11/008; F04C 15/0038; F04C 15/0061; F04C 15/0088; F04C 18/08; F04C 18/082; F04C 18/084; F04C 18/126; F04C 18/16; F04C 18/20; F04C 23/00; F04C 29/005; F01C 1/084; F01C 1/126

See application file for complete search history.

(56) References Cited

U.S. PATENT DOCUMENTS 2,940,661 A * 6/1960 Lorenz ..... F04C 29/0085 417/354
4,714,418 A 12/1987 Matsubara et al.

(Continued)

FOREIGN PATENT DOCUMENTS

JP 60-216089 10/1985
JP 2006-283664 10/2006

*Primary Examiner* — Peter J Bertheaud
(74) *Attorney, Agent, or Firm* — Greenblum & Bernstein, P.L.C.

(57) ABSTRACT

A rotor-chamber wall of a motor-driven Roots pump has a suction port and a discharge port. The side on which the discharge port is located with respect to a plane that includes both the rotational axis of a drive shaft and the rotational axis of a driven shaft is a first side. A first partition wall defines a gear chamber and has a first recess on the first side. A second partition wall defines the gear chamber and has a second recess. The first partition wall has a first oil supply passage that is configured to supply oil from the first recess to a first seal accommodating recess. The second partition wall has a second and a third oil supply passages. The second and the third oil supply passages are configured to supply oil from the second recess to a second and a third seal accommodating recesses, respectively.

7 Claims, 8 Drawing Sheets

(51) Int. Cl.

| | |
|---|---|
| ***F04C 11/00*** | (2006.01) |
| *F04C 23/00* | (2006.01) |
| *F01C 1/12* | (2006.01) |
| *F01C 1/08* | (2006.01) |

(52) U.S. Cl.
CPC ..... *F04C 29/005* (2013.01); *F04C 29/02* (2013.01); *F04C 29/028* (2013.01); *F01C 1/084* (2013.01); *F01C 1/126* (2013.01); *F04C 11/008* (2013.01); *F04C 23/00* (2013.01)

(56) References Cited

U.S. PATENT DOCUMENTS 5,215,501 A * 6/1993 Ushikoshi ..... F04C 29/0064 415/10
5,549,463 A * 8/1996 Ozawa ..... F04C 18/126 418/3
6,688,863 B2 * 2/2004 Hoshino ..... F04C 18/126 418/104
7,320,579 B2 * 1/2008 Hirano ..... F04C 18/084 418/150
8,491,279 B2 * 7/2013 Fujii ..... F04C 18/126 310/216.123
8,784,087 B2 * 7/2014 Hirano ..... F04C 18/084 418/150
2008/0107550 A1 * 5/2008 Fujii ..... F04C 18/126 417/423.1
2008/0107552 A1 * 5/2008 Fujii ..... F04C 2/126 417/423.12
2008/0193301 A1 * 8/2008 Fujii ..... F01C 1/16 417/206

* cited by examiner

MOTOR-DRIVEN ROOTS PUMP

BACKGROUND

The present disclosure relates to a motor-driven Roots pump.

The housing of a motor-driven Roots pump rotationally supports a drive shaft and a driven shaft. The drive shaft and the driven shaft are arranged parallel to each other. The drive shaft is rotated through the driving of an electric motor. A drive gear is fixed to the drive shaft. A driven gear is fixed to the driven shaft and meshed with the drive gear. The drive shaft has a drive rotor and the driven shaft has a driven rotor. The driven rotor is meshed with the drive rotor. As the drive shaft is rotated through the driving of the electric motor, the driven shaft is rotated reversely with respect to the drive shaft through the drive gear and the driven gear, which are meshed with each other. The drive rotor and the driven rotor, which are meshed with each other, are thus rotated in mutually different directions. This allows the motor-driven Roots pump to selectively draw and discharge fluid.

A motor chamber, a gear chamber, and a rotor chamber are formed in the housing. The motor chamber accommodates the electric motor. The gear chamber accommodates the drive gear and the driven gear. The rotor chamber accommodates the drive rotor and the driven rotor. Oil is received in the gear chamber in a sealed manner to lubricate the drive gear and the driven gear and limit a temperature rise. The drive gear and the driven gear are thus dipped in the oil and rotated. This allows for high-speed rotation of the drive gear and the driven gear without causing seizure or wear.

For example, a Roots pump described in Japanese Laid-Open Patent Publication No. 2006-283664 has a motor chamber, a gear chamber, and a rotor chamber in this order along the rotational axis of the drive shaft. The housing of the Roots pump has a first partition wall to separate the gear chamber from the motor chamber in the direction of the rotational axis of the drive shaft. The first partition wall has a first seal accommodating recess to accommodate an annular first seal member. The drive shaft extends through the first seal member. The first seal member seals the gear chamber and the motor chamber from each other. The first seal member prevents oil leakage from the gear chamber into the motor chamber through the first seal accommodating recess. The housing also has a second partition wall to separate the gear chamber from the rotor chamber in the direction of the rotational axis of the drive shaft. The second partition wall has a second seal accommodating recess to accommodate an annular second seal member. The drive shaft extends through the second seal member. The second seal member seals the gear chamber and the rotor chamber from each other. The second seal member prevents oil leakage from the gear chamber into the rotor chamber through the second seal accommodating recess. The second partition wall also has a third seal accommodating recess to accommodate an annular third seal member. The driven shaft extends through the third seal member. The third seal member seals the gear chamber and the rotor chamber from each other. The third seal member prevents oil leakage from the gear chamber into the rotor chamber through the third seal accommodating recess.

If, for example, the level of oil in the gear chamber is located in the vicinity of the rotational axes of the drive shaft and the driven shaft, the first seal member, the second seal member, and the third seal member are partially immersed in the oil in the gear chamber. This lubricates the first seal member, the second seal member, and the third seal member and limits a temperature rise.

When the motor-driven Roots pump is operated, the drive gear and the driven gear rotate while stirring up oil in the gear chamber. If, at this time, the level of oil in the gear chamber is located in the vicinitie of the rotational axes of the drive shaft and the driven shaft, the resistance to stirring of the drive gear and the driven gear increases. The electric power consumed by the electric motor is thus increased. However, if a smaller amount of oil is received in the gear chamber, the oil supply to the first seal member, the second seal member, and the third seal member is hampered.

SUMMARY

Accordingly, it is an objective of the present disclosure to provide a motor-driven Roots pump capable of decreasing resistance to stirring of a drive gear and a driven gear and allowing for stable oil supply to a first seal member, a second seal member, and a third seal member.

In accordance with one aspect of the present disclosure, a motor-driven Roots pump is provided that includes a housing, a drive shaft and a driven shaft that are rotationally supported by the housing in a state arranged parallel to each other in the housing, a drive gear that is fixed to the drive shaft, a driven gear that is fixed to the driven shaft and meshed with the drive gear, a drive rotor that is arranged on the drive shaft, a driven rotor that is arranged on the driven shaft and meshed with the drive rotor, an electric motor that rotates the drive shaft, a motor chamber that is formed in the housing and accommodates the electric motor, a gear chamber that is formed in the housing, accommodates the drive gear and the driven gear, and retains oil in a sealed manner, and a rotor chamber that is formed in the housing and accommodates the drive rotor and the driven rotor. The motor chamber, the gear chamber, and the rotor chamber are arranged in this order along a rotational axis of the drive shaft. The housing includes a first partition wall that separates the gear chamber from the motor chamber in a direction of the rotational axis of the drive shaft, a second partition wall that separates the gear chamber from the rotor chamber in the direction of the rotational axis of the drive shaft, an outer wall that separates the rotor chamber from the exterior in the direction of the rotational axis of the drive shaft, and a rotor-chamber wall that has a shape of a circumferential wall that extends along the rotational axis of the drive shaft and defines the rotor chamber together with the second partition wall and the outer wall. The rotor-chamber wall has, at positions opposed to each other with the rotor chamber in between, a suction port and a discharge port through which the rotor chamber communicates with the exterior. The first partition wall has a first seal accommodating recess that accommodates an annular first seal member for sealing the gear chamber and the motor chamber from each other, with the drive shaft extending through the first seal member. The second partition wall has a second seal accommodating recess that accommodates an annular second seal member for sealing the gear chamber and the rotor chamber from each other, with the drive shaft extending through the second seal member, and a third seal accommodating recess that accommodates an annular third seal for sealing the gear chamber and the rotor chamber from each other, with the driven shaft extending through the third seal member. A side on which the discharge port is located with respect to a plane that includes both the rotational axis of the drive shaft and the rotational axis of the driven shaft is a first side. An end surface of the first partition wall that defines the gear chamber has a first recess on the first side. An end surface of the second partition wall that defines the gear chamber has a second recess that is opposed to the first recess in the direction of the rotational axis. As viewed in the direction of the rotational axis of the drive shaft, the first recess and the second recess at least partially overlap with each other in a range between the drive gear and the driven gear. The first partition wall has a first oil supply passage that is configured to supply the oil from the first recess to the first seal accommodating recess. The second partition wall has a second oil supply passage that is configured to supply oil from the second recess to the second seal accommodating recess, and a third oil supply passage that is configured to supply oil from the second recess to the third seal accommodating recess.

Other aspects and advantages of the present disclosure will become apparent from the following description, taken in conjunction with the accompanying drawings, illustrating exemplary embodiments.

BRIEF DESCRIPTION OF THE DRAWINGS

The disclosure may be understood by reference to the following description together with the accompanying drawings.

DETAILED DESCRIPTION

A motor-driven Roots pump 10 according to an embodiment will now be described with reference to FIGS. 1 to 9.

Figure 1:
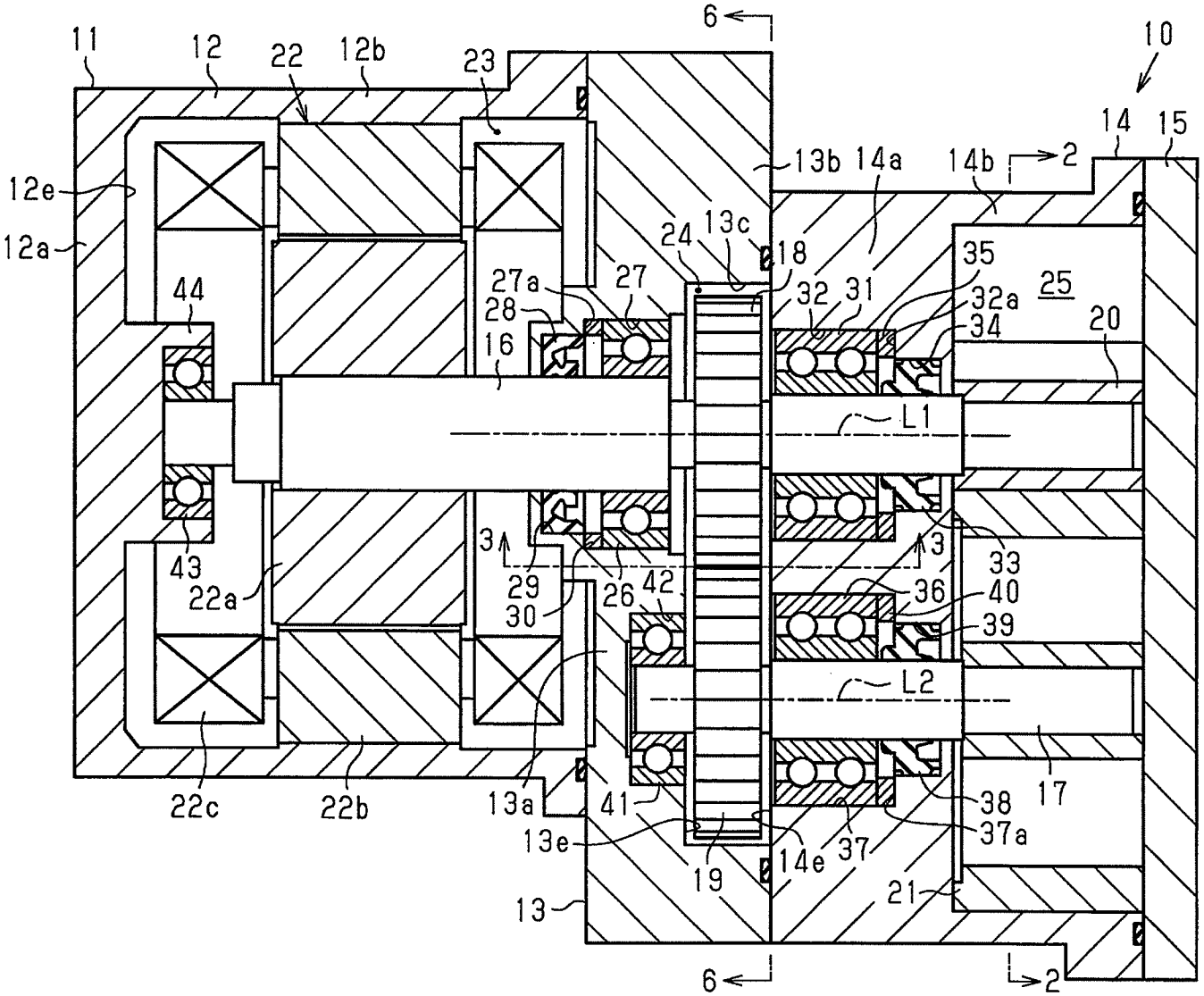
FIG. 1 is a cross-sectional plan view showing a motor-driven Roots pump according to an embodiment.

As shown in FIG. 1, the motor-driven Roots pump 10 includes a housing 11. The housing 11 has a motor-housing member 12, a gear-housing member 13, a rotor-housing member 14, and a cover member 15. The motor-housing member 12 has a disk-like end wall 12*a* and a circumferential wall 12*b* extending from the outer circumferential edge of the end wall 12*a*. The gear-housing member 13 has a plate-like end wall 13*a* and a circumferential wall 13*b* extending from the outer circumferential edge of the end wall 13*a*. The end wall 13*a* of the gear-housing member 13 is joined to the open end of the circumferential wall 12*b* of the motor-housing member 12. The end wall 13*a* of the gear-housing member 13 closes the opening of the circumferential wall 12*b* of the motor-housing member 12.

The rotor-housing member 14 has a plate-like end wall 14*a* and a circumferential wall 14*b* extending from the outer circumferential edge of the end wall 14*a*. The rotor-housing member 14 is joined to the open end of the circumferential wall 13*b* of the gear-housing member 13. The end wall 14*a* of the rotor-housing member 14 closes the opening of the circumferential wall 13*b* of the gear-housing member 13. The cover member 15 is shaped like a plate. The cover member 15 is joined to the open end of the circumferential wall 14*b* of the rotor-housing member 14, is opposed to the end wall 14*a*, and closes the opening of the circumferential wall 14*b*. The axis of the circumferential wall 12*b* of the motor-housing member 12, the axis of the circumferential wall 13*b* of the gear-housing member 13, and the axis of the circumferential wall 14*b* of the rotor-housing member 14 are parallel to one another.

The motor-driven Roots pump 10 includes a drive shaft 16 and a driven shaft 17. The drive shaft 16 and the driven shaft 17 are arranged parallel to each other in the housing 11. The housing 11 rotationally supports the drive shaft 16 and the driven shaft 17. The rotational axes of the drive shaft 16 and the driven shaft 17 are parallel with the axes of the circumferential walls 12*b*, 13*b*, 14*b*. A disk-like drive gear 18 is fixed to the drive shaft 16. A disk-like driven gear 19 is fixed to the driven shaft 17 and meshed with the drive gear 18. The drive shaft 16 has a drive rotor 20. The driven shaft 17 has a driven rotor 21. The driven rotor 21 is meshed with the drive rotor 20.

The motor-driven Roots pump 10 includes an electric motor 22 to rotate the drive shaft 16. A motor chamber 23 is formed in the housing and accommodates the electric motor 22. The motor chamber 23 is defined by the end wall 12*a* of the motor-housing member 12, the circumferential wall 12*b* of the motor-housing member 12, and the end wall 13*a* of the gear-housing member 13. The electric motor 22 has a cylindrical motor rotor 22*a* and a cylindrical stator 22*b*. The motor rotor 22*a* is securely attached to the drive shaft 16 in an integrally rotational manner. The stator 22*b* is fixed to the inner circumferential surface of the circumferential wall 12*b* of the motor-housing member 12 in a manner surrounding the motor rotor 22*a*. The stator 22*b* has coils 22*c*. The coils 22*c* are wound around non-illustrated teeth. The electric motor 22 is driven through electric power supply to the coils 22*c*. The driving of the electric motor 22 rotates the motor rotor 22*a* integrally with the drive shaft 16.

A gear chamber 24 is formed in the housing 11 and accommodates the drive gear 18 and the driven gear 19. The gear chamber 24 is defined by the end wall 13*a* of the gear-housing member 13, the circumferential wall 13*b* of the gear-housing member 13, and the end wall 14*a* of the rotor-housing member 14. The drive gear 18 and the driven gear 19 are accommodated in the gear chamber 24 in a state meshed with each other. Oil is received in the gear chamber 24 in a sealed manner. The oil serves to lubricate the drive gear 18 and the driven gear 19 and limit a temperature rise. The drive gear 18 and the driven gear 19 are dipped in the oil and rotated. This allows for high-speed rotation of the drive gear 18 and the driven gear 19 without causing seizure or wear.

A rotor chamber 25 is formed in the housing 11 and accommodates the drive rotor 20 and the driven rotor 21. The rotor chamber 25 is defined by the end wall 14*a* of the rotor-housing member 14, the circumferential wall 14*b* of the rotor-housing member 14, and the cover member 15. The drive rotor 20 and the driven rotor 21 are accommodated in the rotor chamber 25 in a state meshed with each other. In the present embodiment, the motor chamber 23, the gear chamber 24, and the rotor chamber 25 are arranged in this order along the rotational axis of the drive shaft 16.

The end wall 13*a* of the gear-housing member 13 is used as a first partition wall for separating the gear chamber 24 from the motor chamber 23 in the direction of the rotational axis of the drive shaft 16. The end wall 14*a* of the rotor-housing member 14 is used as a second partition wall for separating the gear chamber 24 from the rotor chamber 25 in the direction of the rotational axis of the drive shaft 16. The cover member 15 is used as an outer wall for separating the rotor chamber 25 from the exterior. That is, the housing 11 has the first partition wall, the second partition wall, and the outer wall. The circumferential wall 14*b* of the rotor-housing member 14 is a rotor-chamber wall that extends along the rotational axis of the drive shaft 16 and defines the rotor chamber 25, together with the second partition wall and the outer wall.

The drive shaft 16 extends through the end wall 13*a* of the gear-housing member 13 and the end wall 14*a* of the rotor-housing member 14. The driven shaft 17 extends through the end wall 14*a* of the rotor-housing member 14. The gear chamber 24 has two inner wall surfaces that are opposed to each other in the direction of the rotational axes of the drive shaft 16 and the driven shaft 17. An inner end surface 13*e* of the end wall 13*a* of the gear-housing member 13 is the end surface of the first partition wall that forms one of the inner wall surfaces of the gear chamber 24 that is closer to the motor chamber 23, that is, the end surface of the first partition wall that defines the gear chamber 24. An outer surface 14*e* of the end wall 14*a* of the rotor-housing member 14 is the end surface of the second partition wall that defines the other one of the inner wall surfaces of the gear chamber 24, which is closer to the rotor chamber 25, that is, the end surface of the second partition wall that defines the gear chamber 24.

An inner end surface 13*e* of the end wall 13*a* of the gear-housing member 13 has a circular hole-like first bearing accommodating recess 27. A first bearing 26 is accommodated in the first bearing accommodating recess 27 and rotationally supports the drive shaft 16. The drive shaft 16 extends through the first bearing accommodating recess 27. An end surface 27*a* of the first bearing accommodating recess 27 has a first seal accommodating recess 29. An annular first seal member 28 is accommodated in the first seal accommodating recess 29. The drive shaft 16 extends through the first seal member 28. The first seal member 28 seals the gear chamber 24 and the motor chamber 23 from each other. That is, the first seal accommodating recess 29 is formed in the end wall 13*a* of the gear-housing member 13. The first seal accommodating recess 29 communicates with the first bearing accommodating recess 27. Also, an annular first spacer 30 is arranged between the first bearing 26 and the end surface 27*a* of the first bearing accommodating recess 27 in the direction of the rotational axis of the drive shaft 16.

An outer surface 14*e* of the end wall 14*a* of the rotor-housing member 14 has a circular hole-like second bearing accommodating recess 32. A second bearing 31 is accommodated in the second bearing accommodating recess 32 and rotationally supports the drive shaft 16. The drive shaft 16 extends through the second bearing accommodating recess 32. An end surface 32*a* of the second bearing accommodating recess 32 has a circular recess-like second seal accommodating recess 34. An annular second seal member 33 is accommodated in the second seal accommodating recess 34. The drive shaft 16 extends through the second seal member 33. The second seal member 33 seals the gear chamber 24 and the rotor chamber 25 from each other. That is, the second seal accommodating recess 34 is formed in the end wall 14*a* of the rotor-housing member 14. The second seal accommodating recess 34 communicates with the second bearing accommodating recess 32. Also, an annular second spacer 35 is arranged between the second bearing 31 and the end surface 32*a* of the second bearing accommodating recess 32 in the direction of the rotational axis of the drive shaft 16.

The outer surface 14*e* of the end wall 14*a* of the rotor-housing member 14 has a circular hole-like third bearing accommodating recess 37. A third bearing 36 is accommodated in the third bearing accommodating recess 37 and rotationally supports the driven shaft 17. The driven shaft 17 extends through the third bearing accommodating recess 37. An end surface 37*a* of the third bearing accommodating recess 37 has a circular hole-like third seal accommodating recess 39. An annular third seal member 38 is accommodated in the third seal accommodating recess 39. The driven shaft 17 extends through the third seal member 38. The third seal member 38 seals the gear chamber 24 and the rotor chamber 25 from each other. That is, the third seal accommodating recess 39 is formed in the end wall 14*a* of the rotor-housing member 14. The third seal accommodating recess 39 communicates with the third bearing accommodating recess 37. Also, an annular third spacer 40 is arranged between the third bearing 36 and the end surface 37*a* of the third bearing accommodating recess 37 in the direction of the rotational axis of the driven shaft 17.

The inner end surface 13*e* of the end wall 13*a* of the gear-housing member 13 has a circular hole-like fourth bearing accommodating recess 42. A fourth bearing 41 is accommodated in the fourth bearing accommodating recess 42 and rotationally supports a first end of the driven shaft 17. The first end of the driven shaft 17 is arranged in the fourth bearing accommodating recess 42 and rotationally supported by the fourth bearing 41. The driven shaft 17 extends through the third bearing accommodating recess 37 and the third seal accommodating recess 39. A second end of the driven shaft 17 projects into the rotor chamber 25. The driven rotor 21 is attached to the second end of the driven shaft 17. The second end of the driven shaft 17 is a free end. In other words, the driven shaft 17 is supported by the housing 11 in a cantilevered manner.

The inner end surface 12*e* of the end wall 12*a* of the motor-housing member 12 has a cylindrical bearing portion 44. A fifth bearing 43 is accommodated in the bearing portion 44 and rotationally supports a first end of the drive shaft 16. The first end of the drive shaft 16 is arranged in the bearing portion 44 and rotationally supported by the fifth bearing 43. The drive shaft 16 extends through the first seal accommodating recess 29, the first bearing accommodating recess 27, the gear chamber 24, the second bearing accommodating recess 32, and the second seal accommodating recess 34. A second end of the drive shaft 16 projects into the rotor chamber 25. The drive rotor 20 is attached to the second end of the drive shaft 16. The second end of the drive shaft 16 is a free end. In other words, the drive shaft 16 is supported by the housing 11 in a cantilevered manner.

Figure 2:
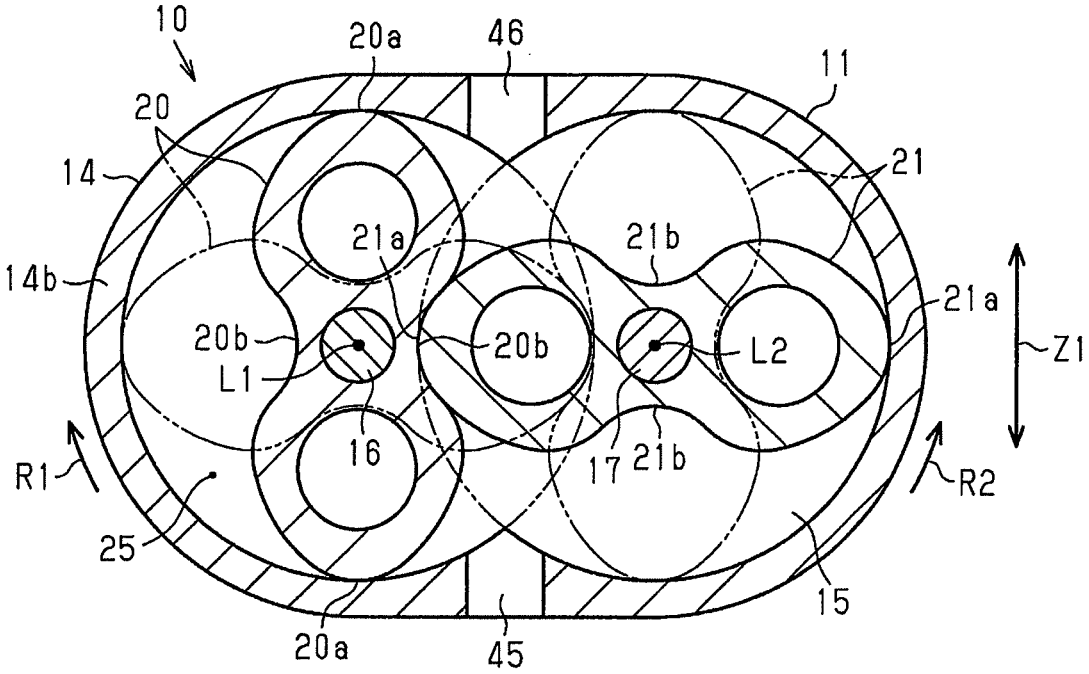
FIG. 2 is a cross-sectional view taken along line 2-2 of FIG. 1.

As illustrated in FIG. 2, the drive rotor 20 and the driven rotor 21 each have a double-lobed shape, that is, a shape with a middle section narrower than opposite side sections, as viewed along a cross section perpendicular to the rotational axes of the drive and driven shafts 16, 17. The drive rotor 20 has two lobes 20*a* and two recesses 20*b*. The recesses 20*b* are formed between the lobes 20*a*. The driven rotor 21 has two lobes 21*a* and two recesses 21*b*. The recesses 21*b* are formed between the lobes 21*a*.

The drive rotor 20 and the driven rotor 21 rotate in the rotor chamber 25 while alternately repeating the meshing between the lobes 20*a* of the drive rotor 20 and the corresponding recesses 21*b* of the driven rotor 21 and the meshing between the recesses 20*b* of the drive rotor 20 and the corresponding lobes 21*a* of the driven rotor 21. The drive rotor 20 rotates in the direction represented by arrow R1 of FIG. 2. The driven rotor 21 rotates in the direction represented by arrow R2 of the drawing.

A suction port 45 and a discharge port 46 are formed in a circumferential wall 14*b* of the rotor-housing member 14 at opposed positions with the rotor chamber 25 in between. The suction port 45 and the discharge port 46 allow the rotor chamber 25 to communicate with the exterior.

The suction port 45 and the discharge port 46 are arranged on a common line. The linear direction Z1 is the extending direction of the common line and extends perpendicular to the rotational axes L1, L2 of the drive shaft 16 and the driven shaft 17. With reference to FIG. 2, the motor-driven Roots pump 10 is installed such that the suction port 45 opens in the gravity direction (downward). In this state, the linear direction Z1 extends in the gravity direction and the rotational axes L1, L2 extend on a common horizontal plane. A plane S includes both of the rotational axes L1, L2 (see FIG. 4). The side on which the discharge port 46 is located with respect to the plane S is referred to as the first side or the discharge-port side. The side on which the suction port 45 is located with respect to the plane S is referred to as the second side or the suction-port side. As shown in FIG. 2, when the motor-driven Roots pump 10 is installed such that the suction port 45 opens downward, the upper side and the lower side with respect to the horizontal plane S are the first side and the second side, respectively.

As the drive shaft 16 is rotated through the driving of the electric motor 22, the driven shaft 17 rotates in the reverse direction with respect to the drive shaft 16 through the drive gear 18 and the driven gear 19, which are meshed with each other. That is, the drive rotor 20 and the driven rotor 21 are rotated in mutually different directions while being meshed with each other. This allows the motor-driven Roots pump 10 to selectively draw fluid into the rotor chamber 25 through the suction port 45 and discharge the fluid from the rotor chamber 25 through the discharge port 46.

Figure 3:
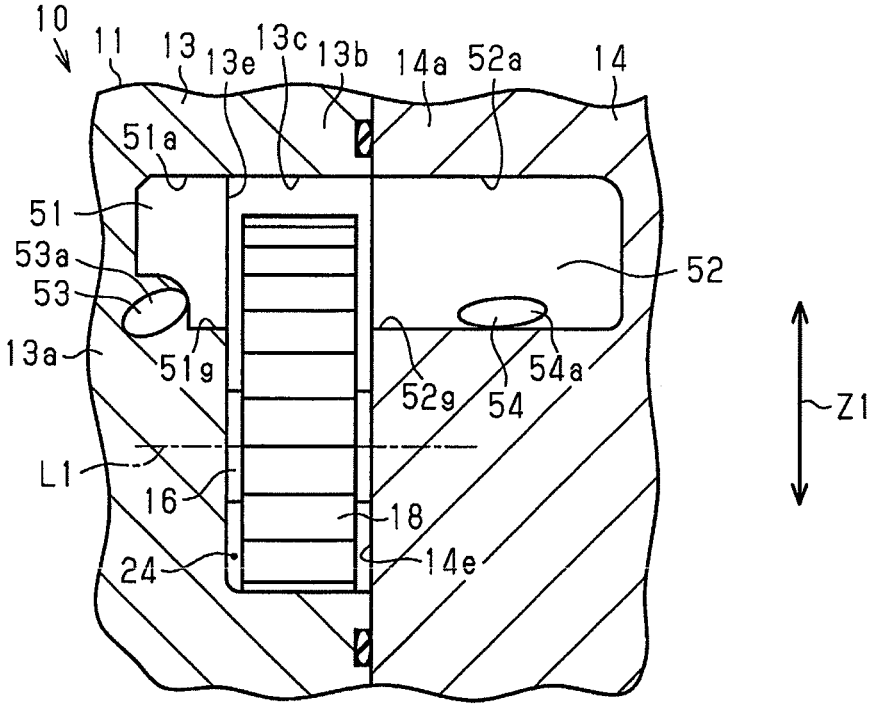
FIG. 3 is a cross-sectional view taken along line 3-3 of FIG. 1.

With reference to FIG. 3, the inner end surface 13*e* of the end wall 13*a* of the gear-housing member 13 has a first recess 51. The outer surface 14*e* of the end wall 14*a* of the rotor-housing member 14 has a second recess 52. The second recess 52 is opposed to the first recess 51 in the direction of the rotational axes of the drive shaft 16 and the driven shaft 17. In FIG. 3, the upper side in the linear direction Z1 is the first side (the discharge-port side). The lower side in the linear direction Z1 is the second side (the suction-port side).

Figure 4:
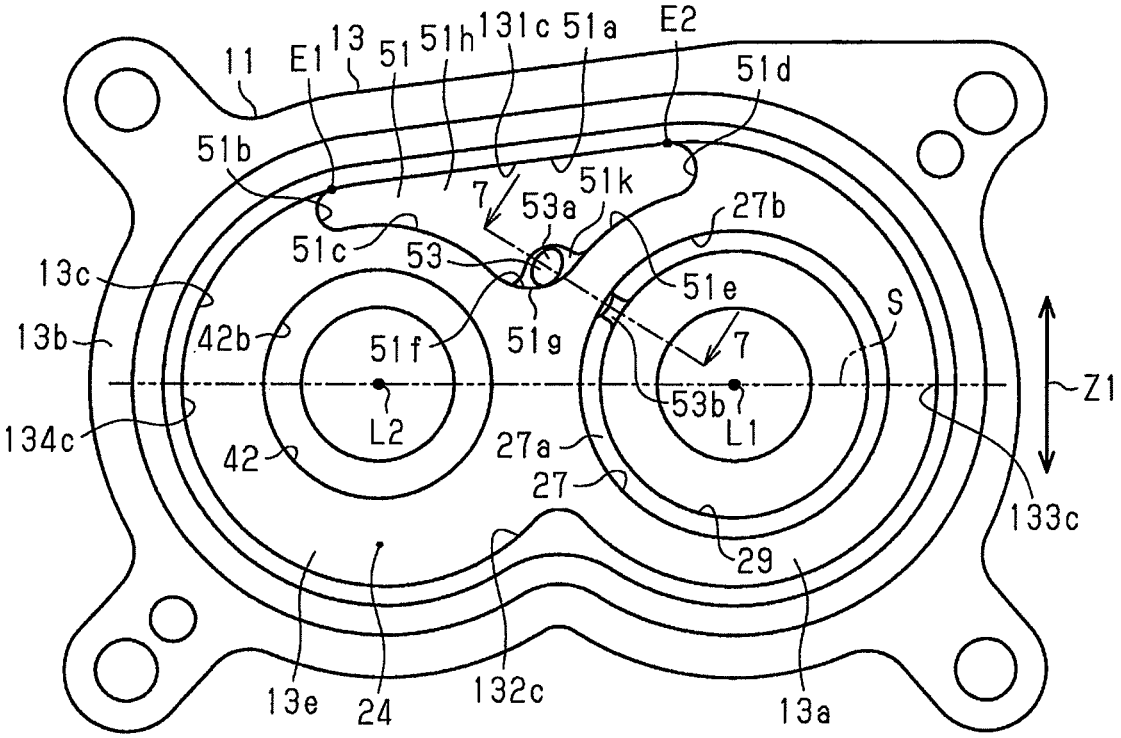
FIG. 4 is a front view showing a gear-housing member of the motor-driven Roots pump of FIG. 1.

As illustrated in FIG. 4, the first recess 51 is formed in a section of the inner end surface 13*e* of the end wall 13*a* of the gear-housing member 13 on the first side, that is, the side on which the discharge port 46 is located with respect to the plane S, which includes both of the rotational axes L1, L2. In FIG. 4, the upper side in the linear direction Z1 is the first side and the lower side in the linear direction Z1 is the second side.

The first recess 51 has a first inner surface 51*a*. The first inner surface 51*a* extends in the direction of the rotational axes of the drive shaft 16 and the driven shaft 17. The circumferential wall 13*b* of the gear-housing member 13 has an inner circumferential surface 13*c*. The inner circumferential surface 13*c* forms the inner circumferential surface of the gear chamber 24. The section of the inner circumferential surface 13*c* located on the first side (the discharge-port side) with respect to the plane S is referred to as a first-side section or discharge-port-side section 131*c*. The first inner surface 51*a* is continuous with the discharge-port-side section 131*c*. If the first recess 51 is viewed in the direction of the rotational axes of the drive shaft 16 and the driven shaft 17, the first inner surface 51*a* extends along the discharge-port-side section 131*c*. As the first recess 51 is viewed in the direction of the rotational axes of the drive shaft 16 and the driven shaft 17, a first edge E1 of the first inner surface 51*a* is located on the first side (the upper side), on which the discharge port 46 is located, with respect to the fourth bearing accommodating recess 42. A second edge E2 of the first inner surface 51*a* is located on the first side (the upper side), on which the discharge port 46 is located, with respect to the first bearing accommodating recess 27.

The first recess 51 has a second inner surface 51*b*. The second inner surface 51*b* is continuous with the first edge E1 of the first inner surface 51*a* and extends in an arcuately curved manner to become closer to the fourth bearing accommodating recess 42 as the distance from the first edge E1 increases. When the first recess 51 is viewed in the direction of the rotational axes of the drive shaft 16 and the driven shaft 17, the second inner surface 51*b* is a curved surface that bulges to become closer to the plane S while becoming more spaced from the second edge E2 of the first inner surface 51*a*.

The first recess 51 has a third inner surface 51*c*. The third inner surface 51*c* is continuous with the edge of the second inner surface 51*b* opposite to the first inner surface 51*a*. The third inner surface 51*c* extends to become closer to the first bearing accommodating recess 27 as the distance from the second inner surface 51*b* increases. The third inner surface 51*c* is a curved surface that is arcuately curved along an inner circumferential surface 42*b* of the fourth bearing accommodating recess 42.

The first recess 51 has a fourth inner surface 51*d*. The fourth inner surface 51*d* is continuous with the second edge E2 of the first inner surface 51*a* and extends in an arcuately curved manner to become closer to the first bearing accommodating recess 27 as the distance from the second edge E2 increases. When the first recess 51 is viewed in the direction of the rotational axes of the drive shaft 16 and the driven shaft 17, the fourth inner surface 51*d* is a curved surface that bulges to become closer to the plane S while becoming more spaced from the first edge E1 of the first inner surface 51*a*.

The first recess 51 has a fifth inner surface 51*e*. The fifth inner surface 51*e* is continuous with the edge of the fourth inner surface 51*d* opposite to the first inner surface 51*a*. The fifth inner surface 51*e* extends to become closer to the fourth bearing accommodating recess 42 as the distance from the fourth inner surface 51*d* increases. The fifth inner surface 51*e* is a curved surface that is arcuately curved along an inner circumferential surface 27*b* of the first bearing accommodating recess 27.

The first recess 51 has a sixth inner surface 51*f*. The sixth inner surface 51*f* couples the edge of the third inner surface 51*c* opposite to the second inner surface 51*b* to the edge of the fifth inner surface 51*e* opposite to the fourth inner surface 51*d*. The sixth inner surface 51*f* is a curved surface that bulges to become closer to the plane S as the distance from the first inner surface 51*a* increases. If the first recess 51 is viewed in the direction of the rotational axes of the drive shaft 16 and the driven shaft 17, the vertex of the sixth inner surface 51*f* (the point most spaced from the first inner surface 51*a*) is a lowermost section 51*g* of the first recess 51 in the gravity direction.

Figure 5:
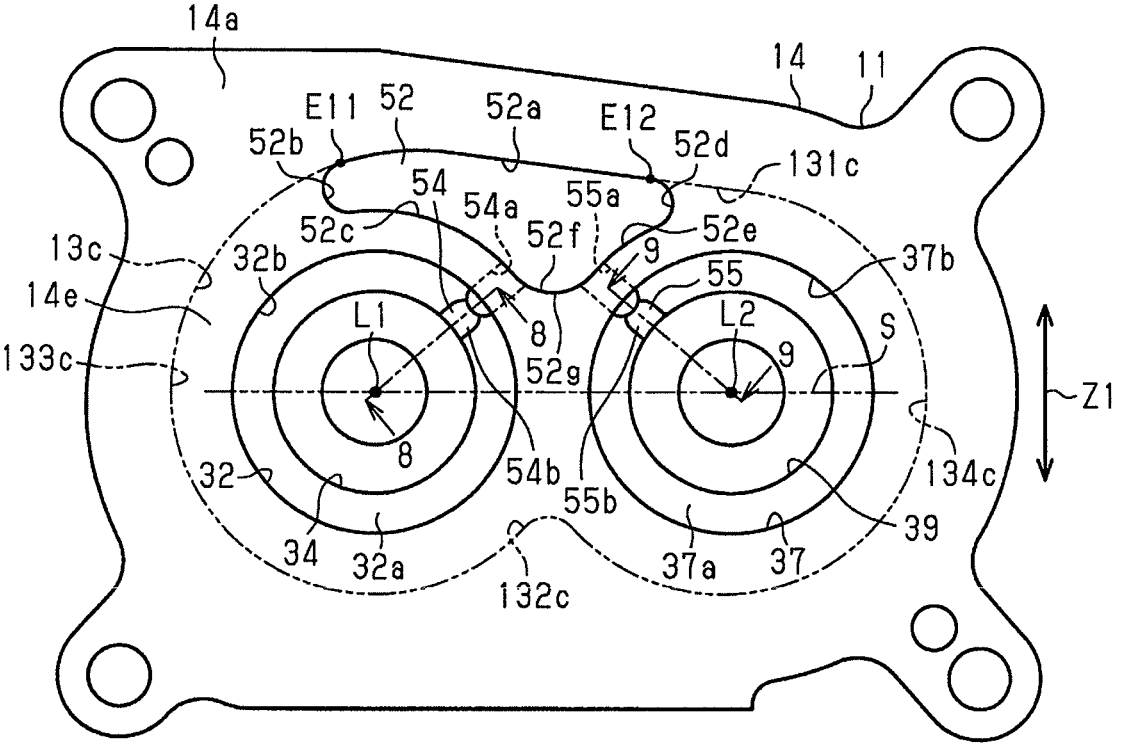
FIG. 5 is a front view showing a rotor-housing member of the motor-driven Roots pump of FIG. 1.

Referring to FIG. 5, the second recess 52 is formed in a section of the outer surface 14*e* of the end wall 14*a* of the rotor-housing member 14 on the first side, that is, the side on which the discharge port 46 is located with respect to the plane S. In FIG. 5, the upper side in the linear direction Z1 is the first side and the lower side in the linear direction Z1 is the second side.

The second recess 52 has a first inner surface 52*a*. The first inner surface 52*a* extends in the direction of the rotational axes of the drive shaft 16 and the driven shaft 17. The first inner surface 52*a* is continuous with the discharge-port-side section 131*c* of the inner circumferential surface 13*c* (as represented by the long dashed double-short dashed line in FIG. 5). If the second recess 52 is viewed in the direction of the rotational axes of the drive shaft 16 and the driven shaft 17, the first inner surface 52*a* extends along the discharge-port-side section 131*c*. If the second recess 52 is viewed in the direction of the rotational axes of the drive shaft 16 and the driven shaft 17, a first edge E11 of the first inner surface 52*a* is located on the side on which the discharge port 46 is located with respect to the second bearing accommodating recess 32. A second edge E12 of the first inner surface 52*a* is located on the side on which the discharge port 46 is located with respect to the third bearing accommodating recess 37.

The second recess 52 has a second inner surface 52*b*. The second inner surface 52*b* is continuous with the first edge E11 of the first inner surface 52*a* and extends in an arcuately curved manner to become closer to the second bearing accommodating recess 32 as the distance from the first edge E11 increases. If the second recess 52 is viewed in the direction of the rotational axes of the drive shaft 16 and the driven shaft 17, the second inner surface 52*b* is a curved surface that bulges to become closer to the plane S while becoming more spaced from the second edge E12 of the first inner surface 52*a*.

The second recess 52 has a third inner surface 52*c*. The third inner surface 52*c* is continuous with the edge of the second inner surface 52*b* opposite to the first inner surface 52*a*. The third inner surface 52*c* extends to become closer to the third bearing accommodating recess 37 as the distance from the second inner surface 52*b* increases. The third inner surface 52*c* is a curved surface that is arcuately curved along an inner circumferential surface 32*b* of the second bearing accommodating recess 32.

The second recess 52 has a fourth inner surface 52*d*. The fourth inner surface 52*d* is continuous with the second edge E12 of the first inner surface 52*a* and extends in an arcuately curved manner to become closer to the third bearing accommodating recess 37 as the distance from the second edge E12 increases. If the second recess 52 is viewed in the direction of the rotational axes of the drive shaft 16 and the driven shaft 17, the fourth inner surface 52*d* is a curved surface that bulges to become closer to the plane S while becoming more spaced from the first edge E11 of the first inner surface 52*a*.

The second recess 52 has a fifth inner surface 52*e*. The fifth inner surface 52*e* is continuous with the edge of the fourth inner surface 52*d* opposite to the first inner surface 52*a*. The fifth inner surface 52*e* extends to become closer to the second bearing accommodating recess 32 as the distance from the fourth inner surface 52*d* increases. The fifth inner surface 52*e* is a curved surface that is arcuately curved along an inner circumferential surface 37*b* of the third bearing accommodating recess 37.

The second recess 52 has a sixth inner surface 52*f*. The sixth inner surface 52*f* couples the edge of the third inner surface 52*c* opposite to the second inner surface 52*b* to the edge of the fifth inner surface 52*e* opposite to the fourth inner surface 52*d*. The sixth inner surface 52*f* is a curved surface that bulges to become closer to the plane S as the distance from the first inner surface 52*a* increases. If the second recess 52 is viewed in the direction of the rotational axes of the drive shaft 16 and the driven shaft 17, the vertex of the sixth inner surface 52*f* (the point most spaced from the first inner surface 52*a* ) is a lowermost section 52*g* of the second recess 52 in the gravity direction.

Figure 6:
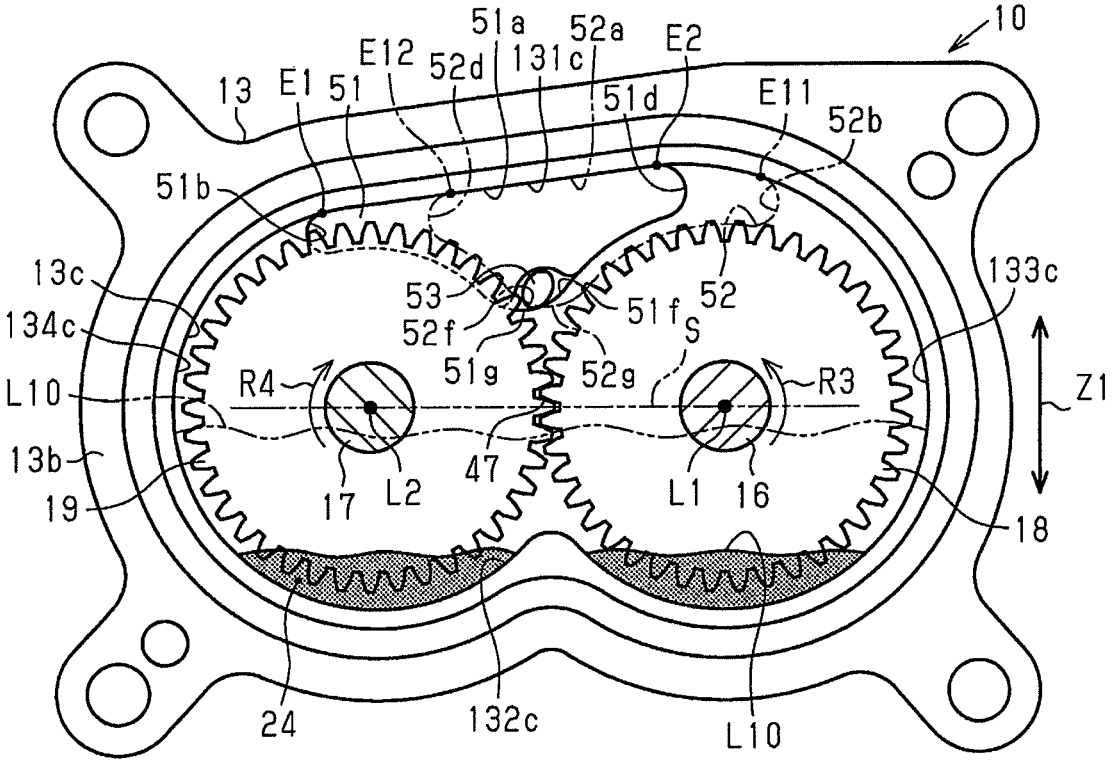
FIG. 6 is a cross-sectional view taken along line 6-6 of FIG. 1.

As illustrated in FIG. 6, as viewed in the direction of the rotational axes of the drive shaft 16 and the driven shaft 17, the sixth inner surface 51*f* of the first recess 51 and the sixth inner surface 52*f* of the second recess 52 cross each other. The lowermost section 51*g* of the first recess 51 is located at the position closest to the plane S. The lowermost section 52*g* of the second recess 52 is also located at the position closest to the plane S. Also, as viewed in the direction of the rotational axes of the drive shaft 16 and the driven shaft 17, each of the lowermost sections 51*g*, 52*g* is located on the side on which the discharge port 46 is located with respect to a meshing portion 47 in which the drive gear 18 and the driven gear 19 are meshed with each other. In FIG. 6, the upper side in the linear direction Z1 is the first side. The lower side in the linear direction Z1 is the second side.

As viewed in the direction of the rotational axes of the drive shaft 16 and the driven shaft 17, the second edge E12 of the first inner surface 52*a* of the second recess 52 is located between the first edge E1 and the second edge E2 of the first inner surface 51*a* of the first recess 51. As viewed in the direction of the rotational axes of the drive shaft 16 and the driven shaft 17, the second edge E2 of the first inner surface 51*a* of the first recess 51 is located between the first edge E11 and the second edge E12 of the first inner surface 52*a* of the second recess 52. Therefore, the fourth inner surface 51*d* of the first recess 51 is located at a position closer to the meshing portion 47 than the second inner surface 52*b* of the second recess 52. The fourth inner surface 52*d* of the second recess 52 is located at a position closer to the meshing portion 47 than the second inner surface 51*b* of the first recess 51.

In the range between the drive gear 18 and the driven gear 19, the first recess 51 and the second recess 52 at least partially overlap with each other. In this range, the minimum distance from the first recess 51 to the plane S, which includes both the rotational axis L1 of the drive shaft 16 and the rotational axis L2 of the driven shaft 17, is equal to the minimum distance from the second recess 52 to the plane S.

In the present embodiment, the drive gear 18 rotates in the direction represented by arrow R3 of FIG. 6. The driven gear 19 rotates in the direction represented by arrow R4 of the drawing. The inner circumferential surface 13*c* of the gear-housing member 13 has, other than the discharge-port-side section 131*c*, a suction-port-side surface 132*c* and connecting surfaces 133*c*, 134*c*. The suction-port-side surface 132*c* is a section on the second side with respect to the plane S. The connecting surfaces 133*c*, 134*c* each connect the discharge-port-side section 131*c* to the suction-port-side surface 132*c*. The connecting surface 133*c* is an arcuately curved surface that extends along the drive shaft 16. The connecting surface 134*c* is an arcuately curved surface that extends along the driven shaft 17. The drive gear 18 and the driven gear 19 rotate from the second side toward the first side with respect to the connecting surface 133*c* and the connecting surface 134*c*, respectively. The electric motor 22 is controlled to rotate the drive gear 18 and the driven gear 19 in the above-described manner.

As the drive gear 18 and the driven gear 19 rotate, the oil in the gear chamber 24 is stirred up toward the first side in the gear chamber 24 through the clearance between the drive gear 18 and the connecting surface 133*c* and the clearance between the driven gear 19 and the connecting surface 134*c*. That is, the oil in the gear chamber 24 is stirred upward against gravity. The oil stirred up by the drive gear 18 and the oil stirred up by the driven gear 19 strike each other on the first side in the gear chamber 24 with respect to the meshing portion 47. The oil thus flows into the first recess 51 and the second recess 52.

Figure 7:
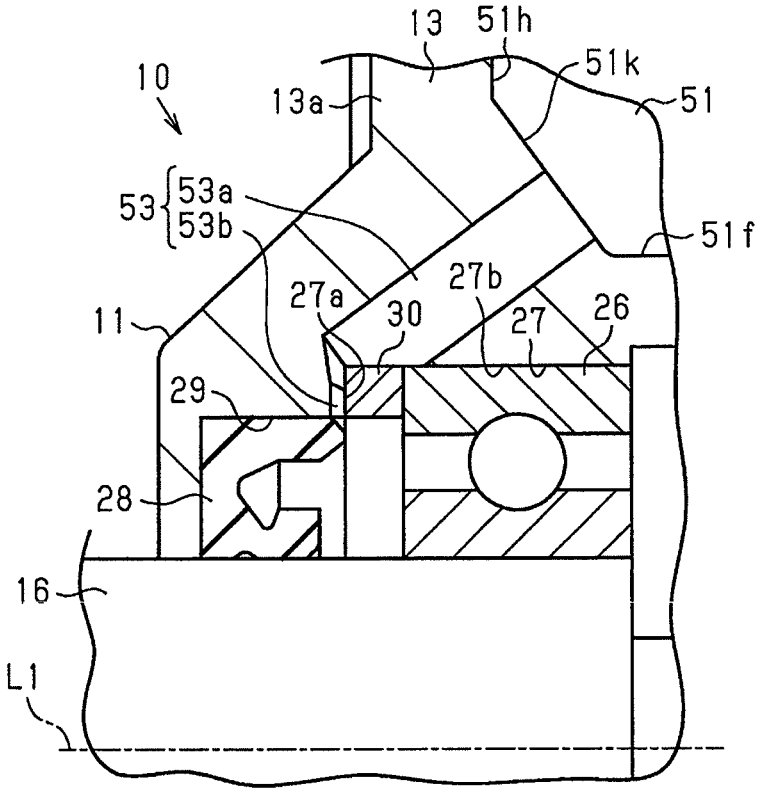
FIG. 7 is a cross-sectional view taken along line 7-7 of FIG. 4.

As shown in FIG. 7, the inner surface of the first recess 51 has a flat surface 51*k*. The flat surface 51*k* couples a bottom surface 51*h* of the first recess 51 to the sixth inner surface 51*f*. The end wall 13*a* of the gear-housing member 13 has a first oil supply passage 53 to supply oil from the first recess 51 to the first seal accommodating recess 29. The first oil supply passage 53 includes a first hole 53*a* and a first groove 53*b*. The first hole 53*a* extends linearly and includes a first end and a second end. The first end opens in the flat surface 51*k* and the second end opens in the end section of the inner circumferential surface 27*b* of the first bearing accommodating recess 27 that contacts the end surface 27*a*. The outer circumferential surface of the first spacer 30 is exposed at the second end of the first hole 53*a*. The first groove 53*b* is formed in the end surface 27*a* of the first bearing accommodating recess 27. The first groove 53*b* includes a first end and a second end. The first end communicates with the second end of the first hole 53*a*. The second end of the first groove 53*b* communicates with the first seal accommodating recess 29. The oil in the first recess 51 is supplied to the first seal accommodating recess 29 through the first hole 53*a* and the first groove 53*b*. Specifically, the diameter of the first hole 53*a* is restricted to such a value that the oil that has flowed into the first recess 51 can be retained in the first recess 51.

Figure 8:
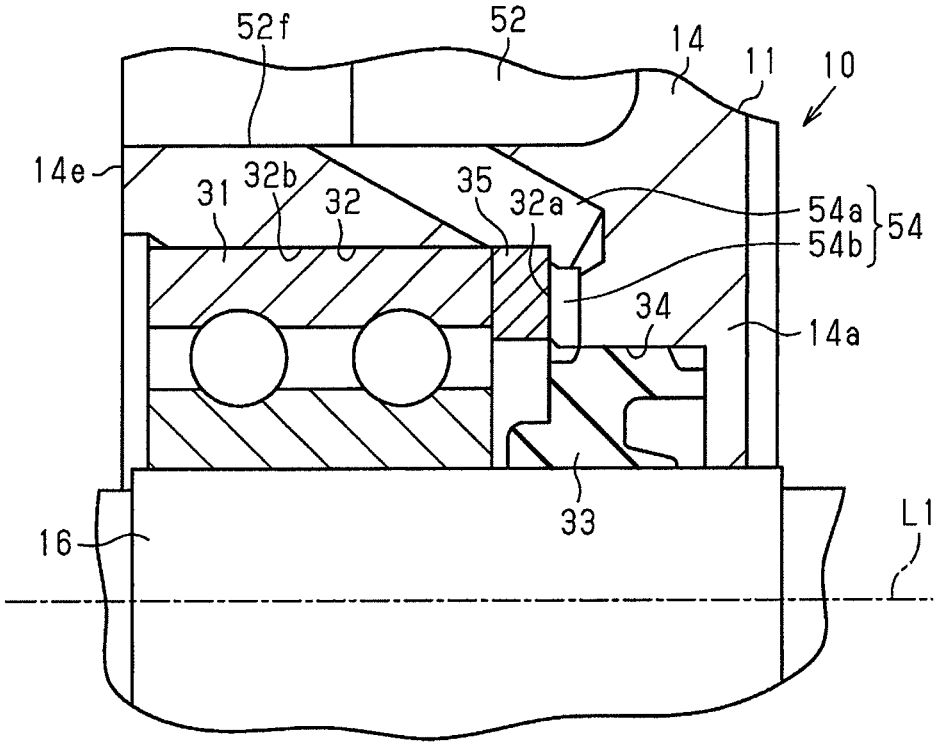
FIG. 8 is a cross-sectional view taken along line 8-8 of FIG. 5.

As shown in FIG. 8, the end wall 14*a* of the rotor-housing member 14 has a second oil supply passage 54 to supply oil from the second recess 52 to the second seal accommodating recess 34. The second oil supply passage 54 includes a second hole 54*a* and a second groove 54*b*. The second hole 54*a* extends linearly and includes a first end and a second end. The first end opens in the sixth inner surface 52*f* of the second recess 52 at a position close to the third inner surface 52*c*. The second end opens in the end section of the inner circumferential surface 32*b* of the second bearing accommodating recess 32 that contacts the end surface 32*a*. The outer circumferential surface of the second spacer 35 is exposed at the second end of the second hole 54*a*. The second groove 54*b* is formed in the end surface 32*a* of the second bearing accommodating recess 32. The second groove 54*b* includes a first end and a second end. The first end communicates with the second end of the second hole 54*a*. The second end of the second groove 54*b* communicates with the second seal accommodating recess 34. The oil in the second recess 52 is supplied to the second seal accommodating recess 34 through the second hole 54*a* and the second groove 54*b*. Specifically, the diameter of the second hole 54*a* is restricted to such a value that the oil that has flowed into the second recess 52 can be retained in the second recess 52.

Figure 9:
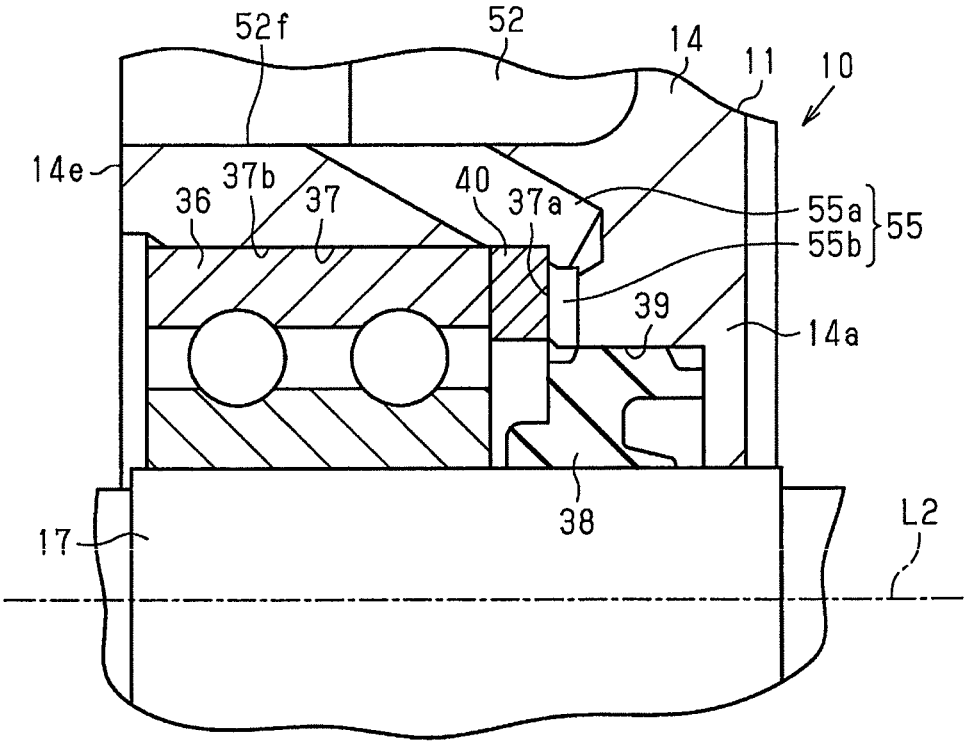
FIG. 9 is a cross-sectional view taken along line 9-9 of FIG. 5.

As shown in FIG. 9, the end wall 14*a* of the rotor-housing member 14 has a third oil supply passage 55 to supply oil from the second recess 52 to the third seal accommodating recess 39. The third oil supply passage 55 includes a third hole 55*a* and a third groove 55*b*. The third hole 55*a* extends linearly and includes a first end and a second end. The first end opens in the sixth inner surface 52*f* of the second recess 52 at a position close to the fifth inner surface 52*e*. The second end opens in the end section of the inner circumferential surface 37*b* of the third bearing accommodating recess 37 that contacts the end surface 37*a*. The outer circumferential surface of the third spacer 40 is exposed at the second end of the third hole 55*a*. The third groove 55*b* is formed in the end surface 37*a* of the third bearing accommodating recess 37. The third groove 55*b* includes a first end and a second end. The first end communicates with the second end of the third hole 55*a*. The second end of the third groove 55*b* communicates with the third seal accommodating recess 39. The oil in the second recess 52 is supplied to the third seal accommodating recess 39 through the third hole 55*a* and the third groove 55*b*. Specifically, the diameter of the third hole 55*a* is restricted to such a value that the oil that has flowed into the second recess 52 can be retained in the second recess 52.

The operation of the present embodiment will hereafter be described.

When the motor-driven Roots pump 10 operates, the oil in the gear chamber 24 is stirred up by the drive gear 18 and the driven gear 19 and thus flows into the first recess 51 and the second recess 52. Specifically, through rotation of the drive gear 18 and the driven gear 19, the oil in the gear chamber 24 is stirred up toward the first side in the gear chamber 24 through the clearance between the drive gear 18 and the connecting surface 133*c* and the clearance between the driven gear 19 and the connecting surface 134*c*. The oil stirred up by the drive gear 18 and the oil stirred up by the driven gear 19 strike each other on the side corresponding to the discharge port 46 with respect to the meshing portion 47 in the gear chamber 24 and then flow into the first recess 51 and the second recess 52.

The fourth inner surface 51*d* of the first recess 51 is located at a position closer to the meshing portion 47 than the second inner surface 52*b* of the second recess 52. The fourth inner surface 52*d* of the second recess 52 is located at a position closer to the meshing portion 47 than the second inner surface 51*b* of the first recess 51. The fourth inner surface 51*d* of the first recess 51 and the fourth inner surface 52*d* of the second recess 52 thus receive the oil that has struck and stirred on the first side with respect to the meshing portion 47. This promotes flows of oil in the first recess 51 and the second recess 52 in the direction of the rotational axes of the drive shaft 16 and the driven shaft 17, thus facilitating the retaining of the oil in the first and second recesses 51, 52.

In FIG. 6, the virtual line (the long dashed double-short dashed line) represents a fluid level L10 of oil in the gear chamber 24. Assume that the motor-driven Roots pump 10 is in a stopped state and oil is received in the gear chamber 24 in a sealed manner such that the fluid level L10 of oil in the gear chamber 24 reaches, for example, a position in the vicinity of the rotational axes L1, L2 of the drive shaft 16 and the driven shaft 17, that is, the position represented by the virtual line. Also in this case, when the motor-driven Roots pump 10 operates, oil in the gear chamber 24 flows into the first recess 51 and the second recess 52. This lowers the fluid level L10 of oil in the gear chamber 24, as represented by the solid line in FIG. 6. As a result, the resistance to stirring of the drive gear 18 and the driven gear 19 decreases.

The oil that has flowed into the first recess 51 is supplied to the first seal accommodating recess 29 through the first oil supply passage 53. The oil that has flowed into the second recess 52 is supplied to the second seal accommodating recess 34 through the second oil supply passage 54 and to the third seal accommodating recess 39 through the third oil supply passage 55. Specifically, in the range between the drive gear 18 and the driven gear 19, the first recess 51 and the second recess 52 at least partially overlap with each other. This facilitates uniform distribution of oil from the gear chamber 24 to the first recess 51 and the second recess 52.

The distance from the lowermost section 51*g*, which is closest to the plane S in the first recess 51, to the plane S is equal to the distance from the lowermost section 52*g*, which is closest to the plane S in the second recess 52, to the plane S. That is, as viewed in the direction of the rotational axis of the drive shaft 16, the minimum distance from the first recess 51 to the plane S, which includes both the rotational axis L1 of the drive shaft 16 and the rotational axis L2 of the driven shaft 17, is equal to the minimum distance from the second recess 52 to the plane S in the range between the drive gear 18 and the driven gear 19. This facilitates uniform distribution of oil from the gear chamber 24 to the first recess 51 and the second recess 52. Stable oil supply is thus ensured for the first seal member 28, the second seal member 33, and the third seal member 38, which are accommodated in the first seal accommodating recess 29, the second seal accommodating recess 34, and the third seal accommodating recess 39, respectively.

The first groove 53*b* of the first oil supply passage 53 is formed in the end surface 27*a* of the first bearing accommodating recess 27. Therefore, the oil that flows out from the first recess 51 into the first groove 53*b* through the first hole 53*a* due to gravity is also supplied to the first bearing accommodating recess 27. This allows for stable oil supply to the first bearing 26. The second groove 54*b* of the second oil supply passage 54 is formed in the end surface 32*a* of the second bearing accommodating recess 32. Therefore, the oil that flows out from the second recess 52 into the second groove 54*b* through the second hole 54*a* due to gravity is also supplied to the second bearing accommodating recess 32. This allows for stable oil supply to the second bearing 31. The third groove 55*b* of the third oil supply passage 55 is formed in the end surface 37*a* of the third bearing accommodating recess 37. Therefore, the oil that flows out from the second recess 52 into the third groove 55*b* through the third hole 55*a* due to gravity is also supplied to the third bearing accommodating recess 37. This allows for stable oil supply to the third bearing 36.

The above-described embodiment has the following advantages.

(1) When the motor-driven Roots pump 10 operates, the fluid level L10 of oil in the gear chamber 24 is lowered by the amount of oil flowing from the gear chamber 24 into the first and second recesses 51, 52. This decreases resistance to stirring of the drive gear 18 and the driven gear 19. The oil that flows into the first recess 51 is supplied to the first seal accommodating recess 29 through the first oil supply passage 53. The oil that flows into the second recess 52 is supplied to the second seal accommodating recess 34 through the second oil supply passage 54 and to the third seal accommodating recess 39 through the third oil supply passage 55. Specifically, in the range between the drive gear 18 and the driven gear 19, the first recess 51 and the second recess 52 at least partially overlap with each other. This facilitates uniform distribution of oil from the gear chamber 24 to the first recess 51 and the second recess 52. Particularly, between the drive gear 18 and the driven gear 19, the oil stirred up by the drive gear 18 and the oil stirred up by the driven gear 19 strike each other intensely. This facilitates oil distribution to the first recess 51 and the second recess 52. As a result, stable oil supply is ensured for the first seal member 28, the second seal member 33, and the third seal member 38, which are accommodated in the first seal accommodating recess 29, the second seal accommodating recess 34, and the third seal accommodating recess 39, respectively.

(2) As viewed in the direction of the rotational axis of the drive shaft 16, in the range between the drive gear 18 and the driven gear 19, the minimum distance from the first recess 51 to the plane S, which includes both the rotational axis L1 of the drive shaft 16 and the rotational axis L2 of the driven shaft 17, is equal to the minimum distance from the second recess 52 to the plane S. This facilitates further uniform distribution of oil from the gear chamber 24 to the first recess 51 and the second recess 52. Further stable oil supply is thus ensured for the first seal member 28, the second seal member 33, and the third seal member 38, which are accommodated in the first seal accommodating recess 29, the second seal accommodating recess 34, and the third seal accommodating recess 39, respectively.

(3) The fourth inner surface 51*d* of the first recess 51 is located at a position closer to the meshing portion 47 than the second inner surface 52*b* of the second recess 52. The fourth inner surface 52*d* of the second recess 52 is located at a position closer to the meshing portion 47 than the second inner surface 51*b* of the first recess 51. This allows the fourth inner surface 51*d* of the first recess 51 and the fourth inner surface 52*d* of the second recess 52 to receive the oil that has struck and stirred on the first side with respect to the meshing portion 47, thus promoting flows of oil in the first recess 51 and the second recess 52 in the direction of the rotational axes of the drive shaft 16 and the driven shaft 17. As a result, the retaining of oil in the first recess 51 and the second recess 52 is facilitated.

(4) The first groove 53*b* of the first oil supply passage 53 is formed in the end surface 27*a* of the first bearing accommodating recess 27. Therefore, the oil that flows out from the first recess 51 into the first groove 53*b* through the first hole 53*a* is also supplied to the first bearing accommodating recess 27. The second groove 54*b* of the second oil supply passage 54 is formed in the end surface 32*a* of the second bearing accommodating recess 32. Therefore, the oil that flows out from the second recess 52 into the second groove 54*b* through the second hole 54*a* is also supplied to the second bearing accommodating recess 32. The third groove 55*b* of the third oil supply passage 55 is formed in the end surface 37*a* of the third bearing accommodating recess 37. Therefore, the oil that flows out from the second recess 52 into the third groove 55*b* through the third hole 55*a* is also supplied to the third bearing accommodating recess 37. As a result, stable oil supply is ensured for the first bearing 26, the second bearing 31, and the third bearing 36. This lubricates the first, second, and third bearings 26, 31, 36 and limits a temperature rise.

The above-described embodiment may be modified as follows.

Figure 10:
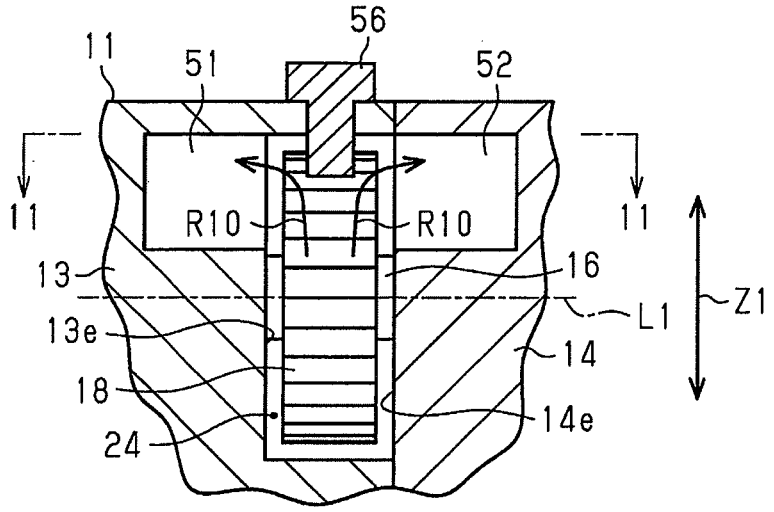
FIG. 10 is an enlarged cross-sectional view showing the interior of a gear chamber according to a first modification.
Figure 11:
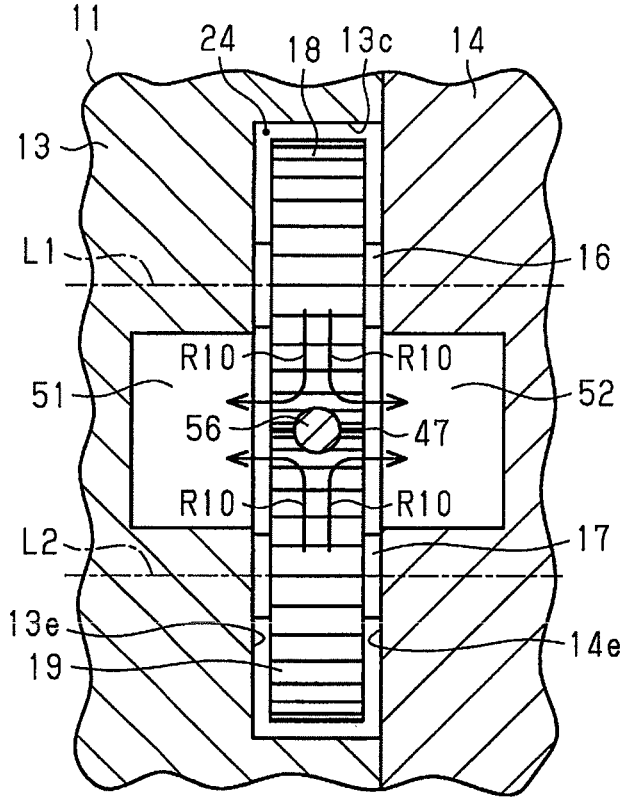
FIG. 11 is a cross-sectional view taken along line 11-11 of FIG. 10.

As shown in FIGS. 10 and 11, a guide portion may be arranged between the first recess 51 and the second recess 52 in the direction of the rotational axes of the drive shaft 16 and the driven shaft 17 in the gear chamber 24. The guide portion guides oil toward the first recess 51 and the second recess 52. In the embodiment shown in FIGS. 10 and 11, a drain plug 56 is employed as the guide portion. The drain plug 56 is located on the side on which the discharge port 46 is located with respect to the meshing portion 47 between the drive gear 18 and the driven gear 19. As indicated by the oil flows represented by arrows R10 in FIGS. 10 and 11, the drain plug 56 guides oil to the first recess 51 and the second recess 52 in the gear chamber 24 after the oil is stirred up by the drive gear 18 and the driven gear 19. In FIG. 10, the upper side in the linear direction Z1 is the first side and the lower side in the linear direction Z1 is the second side.

In other words, the oil is stirred up by the drive gear 18 or the driven gear 19 through the clearance between the drive gear 18 and the inner circumferential surface 13*c* of the gear-housing member 13 and the clearance between the driven gear 19 and the inner circumferential surface 13*c* of the gear-housing member 13. The oil is then guided by the drain plug 56 on the first side with respect to the meshing portion 47 between the drive gear 18 and the driven gear 19. This facilitates the flowing of the oil into the first recess 51 and the second recess 52. As a result, when the motor-driven Roots pump 10 operates, the lowering of the fluid level L10 of oil in the gear chamber 24 and the decreasing of the resistance to stirring of the drive gear 18 and the driven gear 19 are facilitated. Also, the drain plug 56 facilitates the flowing of oil from the gear chamber 24 into the first recess 51 and the second recess 52. This facilitates stable oil supply to the first seal member 28, the second seal member 33, and the third seal member 38. Further, since the drain plug 56 with a known configuration is employed as a guide portion, it is unnecessary to provide an independent component that is used as the guide portion. This maintains, without increasing, the number of components.

Figure 12:
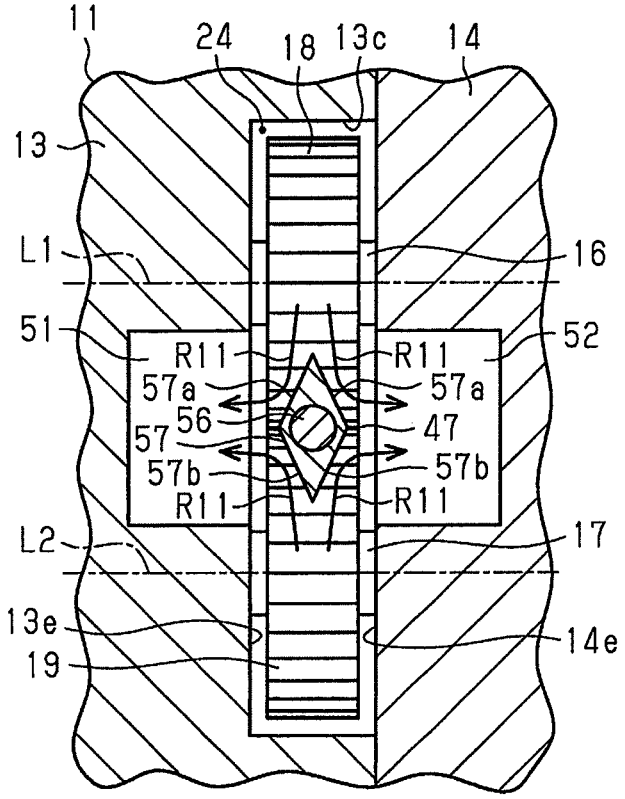
FIG. 12 is an enlarged cross-sectional view showing the interior of a gear chamber according to a second modification.

With reference to FIG. 12, a guide portion 57 may be arranged between the first recess 51 and the second recess 52 in the direction of the rotational axes of the drive shaft 16 and the driven shaft 17 in the gear chamber 24. The guide portion 57 guides oil toward the first recess 51 and the second recess 52. The guide portion 57 is attached to the drain plug 56. As viewed from above, the guide portion 57 has, for example, a rhomboidal shape. However, the shape of the guide portion 57 is not restricted to any particular shape.

The guide portion 57 has two first guide surfaces 57*a*. The first guide surfaces 57*a* guide oil toward the first recess 51 or the second recess 52 after the oil is stirred up by the drive gear 18 through the clearance between the drive gear 18 and the inner circumferential surface 13*c* of the gear-housing member 13. When a plane that includes both the rotational axis L1 of the drive shaft 16 and the rotational axis L2 of the driven shaft 17 is viewed from above, the first guide surfaces 57*a* are inclined surfaces that extend to become more spaced from each other from the drive gear 18 toward the driven gear 19. The guide portion 57 also has two second guide surfaces 57*b*. The second guide surfaces 57*b* guide oil toward the first recess 51 or the second recess 52 after the oil is stirred up by the driven gear 19 through the clearance between the driven gear 19 and the inner circumferential surface 13*c* of the gear-housing member 13. When a plane that includes both the rotational axis L1 of the drive shaft 16 and the rotational axis L2 of the driven shaft 17 is viewed from above, the second guide surfaces 57*b* are inclined surfaces that extend to become more spaced from each other from the drive gear 18 toward the driven gear 19.

As represented by the flows of oil indicated by arrows R11 in FIG. 12, the two first guide surfaces 57*a* and the two second guide surfaces 57*b* guide oil from the gear chamber 24 to the first recess 51 and the second recess 52 after the oil is stirred up by the drive gear 18 and the driven gear 19. This facilitates the flowing of the oil in the gear chamber 24, which has been stirred up by the drive gear 18 and the driven gear 19, into the first recess 51 and the second recess 52 while the oil is guided by the guide portion 57.

In the embodiment shown in FIG. 12, the guide portion 57 does not necessarily have to be attached to the drain plug 56 but may be attached to the circumferential wall 13*b* of the gear-housing member 13 through a support member.

In the embodiment shown in FIGS. 10 and 11, the drain plug 56 may be arranged at a position horizontally offset from the meshing portion 47 to become close to the drive gear 18 or the driven gear 19, as viewed from above, instead of being arranged immediately above the meshing portion 47.

In the embodiment shown in FIG. 12, the drain plug 56 and the guide portion 57 may each be arranged at a position horizontally offset from the meshing portion 47 to become close to the drive gear 18 or the driven gear 19, as viewed from above, instead of being arranged immediately above the meshing portion 47.

Figure 13:
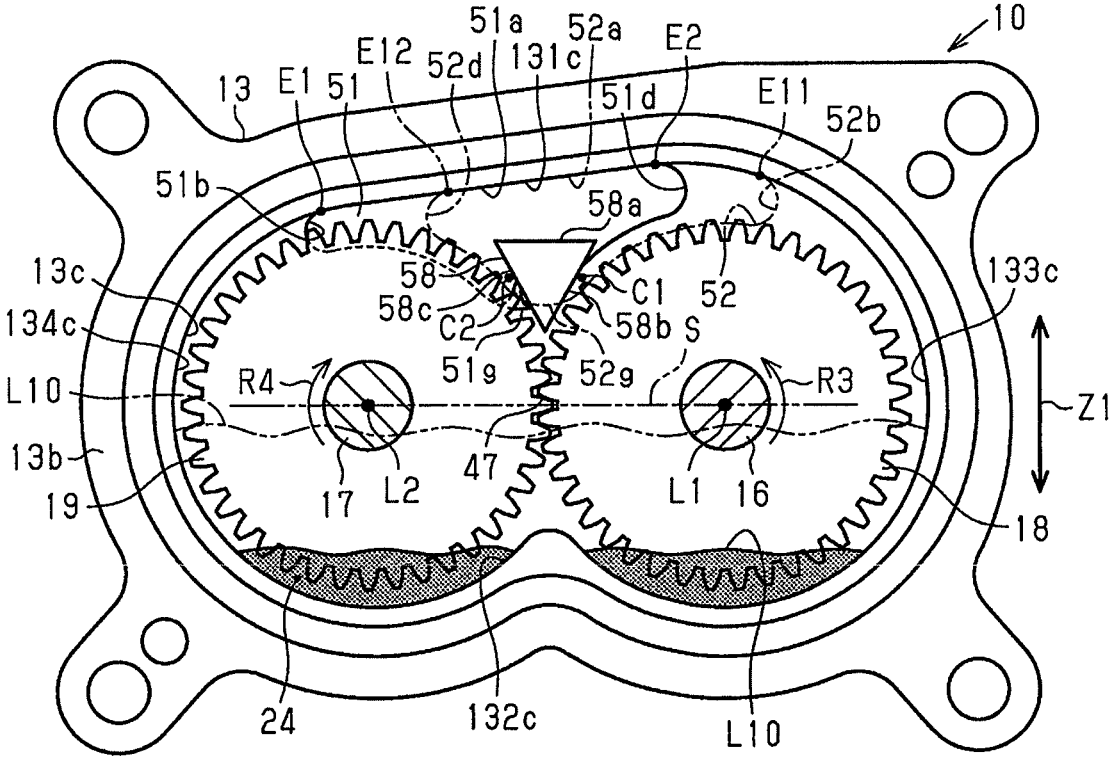
FIG. 13 is an enlarged cross-sectional view showing a section of a motor-driven Roots pump according to a third modification.
Figure 14:
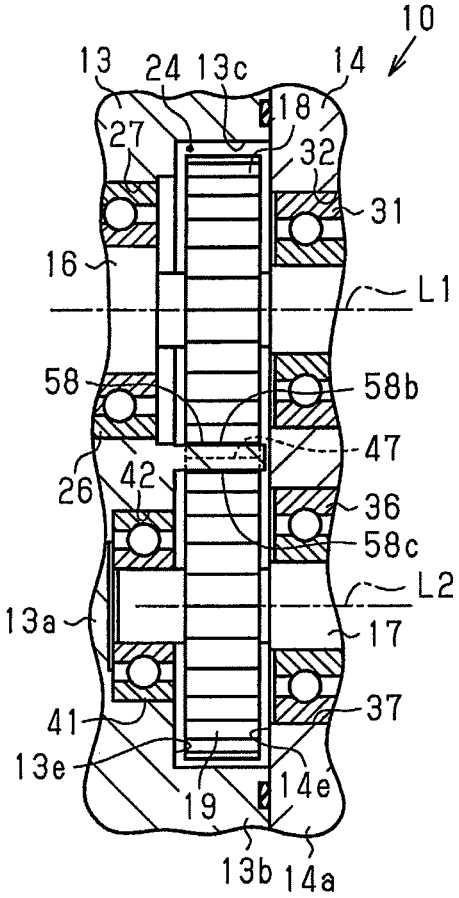
FIG. 14 is an enlarged cross-sectional view showing a section of the motor-driven Roots pump of FIG. 13.

As illustrated in FIGS. 13 and 14, the motor-driven Roots pump 10 may include a separator portion 58. The separator portion 58 is arranged between the first recess 51 and the second recess 52 in the gear chamber 24 in the direction of the rotational axes of the drive shaft 16 and the driven shaft 17. The separator portion 58 is arranged on the side on which the discharge port 46 is located with respect to the meshing portion 47 between the drive gear 18 and the driven gear 19. Referring to FIG. 13, the separator portion 58 has a triangular shape as viewed in the direction of the rotational axes of the drive shaft 16 and the driven shaft 17. In FIG. 13, the upper side in the linear direction Z1 is a first side and the lower side in the linear direction Z1 is a second side.

With reference to FIG. 14, the separator portion 58 is shaped like a triangular prism projecting from the inner end surface 13*e* of the end wall 13*a* of the gear-housing member 13. The separator portion 58 is formed integrally with the gear-housing member 13. The end section of the separator portion 58 opposite to the inner end surface 13*e* of the end wall 13*a* of the gear-housing member 13 is located upward in the space between the end surfaces of the drive gear 18 and the driven gear 19 and the outer surface 14*e* of the end wall 14*a* of the rotor-housing member 14. As a result, the separator portion 58 projects from the inner end surface 13*e* of the end wall 13*a* of the gear-housing member 13, extends above the meshing portion 47, and reach a position immediately before the outer surface 14*e* of the end wall 14*a* of the rotor-housing member 14.

As illustrated in FIG. 13, the separator portion 58 has a spaced surface 58*a*. The spaced surface 58*a* is spaced from the section 131*c*, in which the discharge port 46 is located, in the inner circumferential surface 13*c* of the circumferential wall 13*b* of the gear-housing member 13, which forms the inner circumferential surface of the gear chamber 24. The spaced surface 58*a* is shaped like a flat surface that extends along the plane S.

The separator portion 58 also has a first surface 58*b* and a second surface 58*c*. The first surface 58*b* is shaped like a flat surface that extends linearly from the corresponding one of the opposite transverse edges (the right edge in FIG. 13)

in a direction perpendicular to both the rotational axes L1, L2 and the linear direction Z1 toward the meshing portion 47. The second surface 58*c* is shaped like a flat surface that extends linearly from the other one of the opposite transverse edges (the left edge in FIG. 13) in the direction perpendicular to both the rotational axes L1, L2 and the linear direction Z1 toward the meshing portion 47. The first surface 58*b* and the second surface 58*c* extend to become closer to each other as the distance from the spaced surface 58*a* increases. The edge of the first surface 58*b* opposite to the spaced surface 58*a* and the edge of the second surface 58*c* opposite to the spaced surface 58*a* contact each other. The first surface 58*b* is opposed to the drive gear 18. The second surface 58*c* is opposed to the driven gear 19.

The clearance C1 between the first surface 58*b* and the drive gear 18 is used as a restriction located immediately before the meshing portion 47 in the rotational direction of the drive gear 18 (the direction represented by arrow R3 in FIG. 13). Being used as a restriction, the clearance C1 hampers the flowing, toward the meshing portion 47, of the oil that has been stirred up through the clearance between the drive gear 18 and the inner circumferential surface 13*c* through rotation of the drive gear 18.

The clearance C2 between the second surface 58*c* and the driven gear 19 is used as a restriction located immediately before the meshing portion 47 in the rotational direction of the driven gear 19 (the direction represented by arrow R4 in FIG. 13). Being used as a restriction, the clearance C2 hampers the flowing, toward the meshing portion 47, of the oil that has been stirred up through the clearance between the driven gear 19 and the inner circumferential surface 13*c* through rotation of the driven gear 19.

After having been stirred up by the drive gear 18 and the driven gear 19 through the clearance between the drive gear 18 and the inner circumferential surface 13*c* and the clearance between the driven gear 19 and the inner circumferential surface 13*c*, respectively, the oil flows into the space between the section 131*c* and the spaced surface 58*a*. The oil that has flowed into this space then flows into the first recess 51 and the second recess 52. As a result, the separator portion 58 makes it less likely that the oil that has been stirred up by the drive gear 18 and the driven gear 19 will enter the meshing portion 47 without flowing into the first recess 51 or the second recess 52. This, in turn, makes it less likely that the oil will enter the meshing portion 47 and become trapped between the drive gear 18 and the driven gear 19 and thus hamper smooth rotation of the drive gear 18 and the driven gear 19. As a result, the electric power consumed by the electric motor 22 decreases.

In the embodiment illustrated in FIGS. 13 and 14, the separator portion 58 may project from the section 131*c*, instead of projecting from the inner end surface 13*e*. In this case, the separator portion 58 has a claw-like shape formed by a first extending portion and a second extending portion, for example. The first extending portion extends from the section 131*c* toward the meshing portion 47. The second extending portion is curved from the distal end section of the first extending portion and extends in the direction of the rotational axes of the drive shaft 16 and the driven shaft 17. The second extending portion has the spaced surface 58*a*.

In the embodiment shown in FIGS. 13 and 14, the end section of the separator portion 58 opposite to the inner end surface 13*e* may be located above the meshing portion 47. That is, the separator portion 58 may project from the inner end surface 13*e* and extend only to a position midway above the meshing portion 47.

In the embodiment shown in FIGS. 13 and 14, the separator portion 58 may be a component independent of the gear-housing member 13.

In the embodiment illustrated in FIGS. 13 and 14, the separator portion 58 may project from the outer surface 14*e* of the end wall 14*a* of the rotor-housing member 14.

In the embodiments, the first inner surface 51*a* and the first inner surface 52*a* may each have multiple projections. This configuration causes the oil that has flowed into the first recess 51 and the second recess 52 to adhere to the first inner surface 51*a* and the first inner surface 52*a*, respectively, due to surface tension. This facilitates the retaining of the oil in the first recess 51 and the second recess 52.

In the embodiments, for example, the fourth inner surface 51*d* of the first recess 51 may be located at a position where the fourth inner surface 51*d* overlaps with the second inner surface 52*b* of the second recess 52 in the direction of the rotational axes of the drive shaft 16 and the driven shaft 17. Also, for example, the fourth inner surface 52*d* of the second recess 52 may be located at a position where the fourth inner surface 52*d* overlaps with the second inner surface 51*b* of the first recess 51 in the direction of the rotational axes of the drive shaft 16 and the driven shaft 17.

In the embodiments, as viewed in the direction of the rotational axis of the drive shaft 16, the minimum distance from the first recess 51 to the plane S may be unequal to the minimum distance from the second recess 52 to the plane S in the range between the drive gear 18 and the driven gear 19.

In the embodiments, the cross section of each of the drive rotor 20 and the driven rotor 21 perpendicular to the direction of the rotational axes of the drive shaft 16 and the driven shaft 17 may have, for example, a three-lobed or four-lobed shape.

In the embodiments, the drive rotor 20 and the driven rotor 21 may have, for example, a helical shape.

The invention claimed is:

1. A motor-driven Roots pump comprising:

a housing;

a drive shaft and a driven shaft that are rotationally supported by the housing in a state arranged parallel to each other in the housing;

a drive gear that is fixed to the drive shaft;

a driven gear that is fixed to the driven shaft and meshed with the drive gear;

a drive rotor that is arranged on the drive shaft;

a driven rotor that is arranged on the driven shaft and meshed with the drive rotor;

an electric motor that rotates the drive shaft;

a motor chamber that is formed in the housing and accommodates the electric motor;

a gear chamber that is formed in the housing, accommodates the drive gear and the driven gear, and retains oil in a sealed manner; and a rotor chamber that is formed in the housing and accommodates the drive rotor and the driven rotor, wherein the motor chamber, the gear chamber, and the rotor chamber are arranged in this order along a rotational axis of the drive shaft, the housing includes a first partition wall that separates the gear chamber from the motor chamber in a direction of the rotational axis of the drive shaft, a second partition wall that separates the gear chamber from the rotor chamber in the direction of the rotational axis of the drive shaft, an outer wall that separates the rotor chamber from the exterior in the direction of the rotational axis of the drive shaft, and a rotor-chamber wall that has a shape of a circumferential wall that extends along the rotational axis of the drive shaft and defines the rotor chamber together with the second partition wall and the outer wall, wherein the rotor-chamber wall has, at positions opposed to each other with the rotor chamber in between, a suction port and a discharge port through which the rotor chamber communicates with the exterior, the first partition wall has a first seal accommodating recess that accommodates an annular first seal member for sealing the gear chamber and the motor chamber from each other, with the drive shaft extending through the first seal member, the second partition wall has a second seal accommodating recess that accommodates an annular second seal member for sealing the gear chamber and the rotor chamber from each other, with the drive shaft extending through the second seal member, and a third seal accommodating recess that accommodates an annular third seal for sealing the gear chamber and the rotor chamber from each other, with the driven shaft extending through the third seal member, a side on which the discharge port is located with respect to a plane that includes both the rotational axis of the drive shaft and the rotational axis of the driven shaft is a first side, an end surface of the first partition wall that defines the gear chamber has a first recess on the first side, an end surface of the second partition wall that defines the gear chamber has a second recess that is opposed to the first recess in the direction of the rotational axis, as viewed in the direction of the rotational axis of the drive shaft, the first recess and the second recess at least partially overlap with each other in a range between the drive gear and the driven gear, the first partition wall has a first oil supply passage that is configured to supply the oil from the first recess to the first seal accommodating recess, and the second partition wall has a second oil supply passage that is configured to supply oil from the second recess to the second seal accommodating recess, and a third oil supply passage that is configured to supply oil from the second recess to the third seal accommodating recess.

2. The motor-driven Roots pump according to claim 1, wherein, as viewed in the direction of the rotational axis of the drive shaft and in the range between the drive gear and the driven gear, a minimum distance from the first recess to the plane that includes both the rotational axis of the drive shaft and the rotational axis of the driven shaft is equal to a minimum distance from the second recess to the plane.

3. The motor-driven Roots pump according to claim 1, wherein a guide portion is arranged in the gear chamber and located between the first recess and the second recess in the direction of the rotational axis, and the guide portion is configured to guide oil toward the first recess and the second recess.

4. The motor-driven Roots pump according to claim 3, wherein the guide portion is located on a side on which the discharge port is located with respect to a meshing portion in which the drive gear and the driven gear are meshed with each other.

5. The motor-driven Roots pump according to claim 3, wherein the guide portion is a drain plug.

6. The motor-driven Roots pump according to claim 3, wherein the guide portion has two first guide surfaces that are configured to guide oil after the oil is stirred up by the drive gear and two second guide surfaces that are configured to guide oil after the oil is stirred up by the driven gear, and when a plane that includes both the rotational axis of the drive shaft and the rotational axis of the driven shaft is viewed from above, the two first guide surfaces extend to become more spaced from each other from the drive gear toward the driven gear and the two second guide surfaces extend to become more spaced from each other from the driven gear toward the drive gear.

7. The motor-driven Roots pump according to claim 1, comprising a separator portion that is arranged between the first recess and the second recess in the direction of the rotational axis in the gear chamber and on a side on which the discharge port is located with respect to a meshing portion in which the drive gear and the driven gear are meshed with each other, wherein an inner circumferential surface of the housing that defines the gear chamber has a first-side section that is located on the first side, and the separator portion has a spaced surface that is spaced from the first-side section.

* * * * *